US005255795A

United States Patent [19]

Kitmitto

[11] Patent Number: 5,255,795

[45] Date of Patent: Oct. 26, 1993

[54] TEST FIXTURE

[75] Inventor: Gamille Kitmitto, Gilbert, Ariz.

[73] Assignee: VLSI Technology, Inc., San Jose, Calif.

[21] Appl. No.: 803,235

[22] Filed: Dec. 5, 1991

[51] Int. Cl.[5] ..... A47F 7/00

[52] U.S. Cl. ..... 211/13; 211/DIG. 1; 269/8; 248/206.5; 206/818

[58] Field of Search ..... 211/DIG. 1, 13, 70.6, 211/60.1; 248/206.5; 324/158 F; 269/8, 900, 903; 206/818, 350, 565

[56] References Cited

U.S. PATENT DOCUMENTS

| | | | |
|---|---|---|---|
| 2,172,172 | 9/1939 | Mount | 211/13 X |
| 2,346,582 | 4/1944 | Insler et al. | 211/DIG. 1 X |
| 2,475,450 | 7/1949 | Dvorak | 206/818 X |
| 2,502,056 | 3/1950 | Million | 269/900 X |
| 2,511,774 | 6/1950 | Goldsmith | 206/818 X |
| 2,954,874 | 10/1960 | Rouse | 211/13 |
| 2,965,235 | 12/1960 | Daline | 211/DIG. 1 X |
| 3,239,069 | 3/1966 | Hollins | 211/194 X |
| 3,262,232 | 7/1966 | Hilbrunner | 269/8 |
| 3,268,428 | 8/1966 | Buccino | 269/8 |
| 3,650,032 | 3/1972 | Kestler | 206/818 X |
| 3,726,393 | 4/1973 | Thompson | 211/13 X |
| 4,337,860 | 7/1982 | Carrigan | 206/818 X |
| 4,542,890 | 9/1985 | Braillon | 269/8 |
| 5,067,433 | 11/1991 | Doll, Jr. et al. | 269/8 X |
| 5,067,695 | 11/1991 | Huddleston | 269/8 X |
| 5,080,230 | 1/1992 | Winnard | 211/DIG. 1 X |

OTHER PUBLICATIONS

Am. Mach. Jun. 2, 1949 "Staggered Construction Improves Magnetic Blocks".

*Primary Examiner*—David A. Scherbel
*Assistant Examiner*—Korie H. Chan
*Attorney, Agent, or Firm*—Richard R. Mybeck

[57] ABSTRACT

The present invention relates to means and methods for testing microelectronic parts and devices including a special fixture that provides a stable support for holding packaged integrated circuit boards and the like at a specially selected angle in an environmental or humidity testing chamber. A plurality of holes are defined into a sloping surface of a plastic block, into which magnets are strategically placed to define a preselected pattern. Packaged parts are then placed on the magnets and secured thereto by the magnetic attraction through the package between the magnet and the lid of the part packaged. Thus mounted, the parts are maintain at a 45° angle and all surfaces are exposed equally to the settling fog within the chamber.

10 Claims, 1 Drawing Sheet

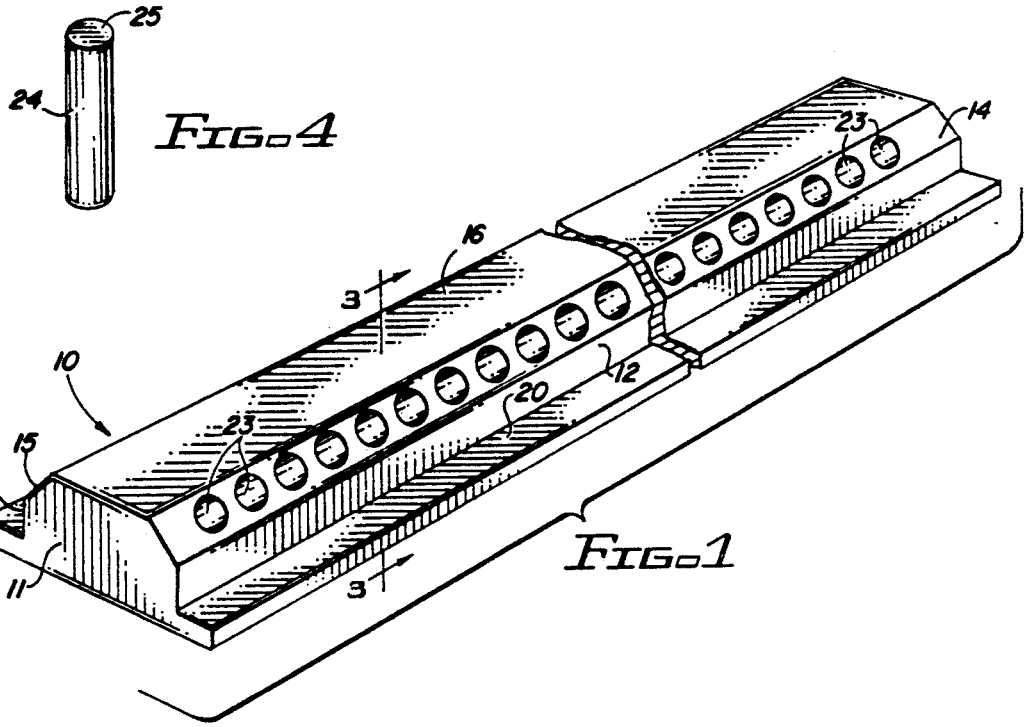
FIG. 4
FIG. 1
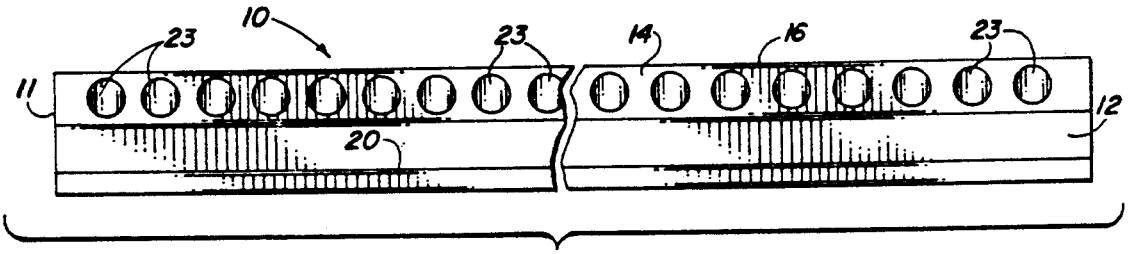
FIG. 2
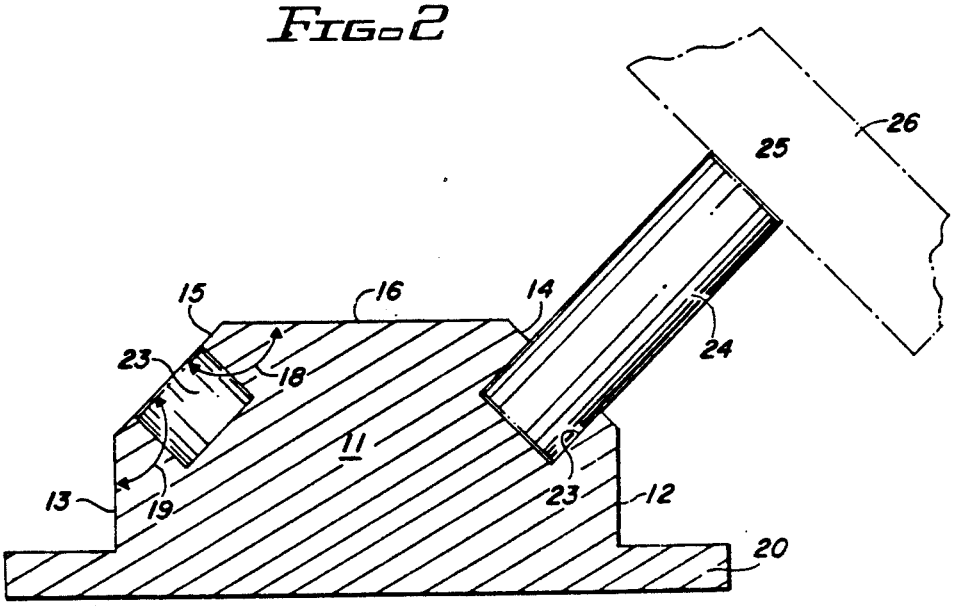
FIG. 3

TEST FIXTURE

INTRODUCTION

The present invention relates generally to the testing of integrated circuit boards and more particularly to a test fixture for supporting prepackaged integrated circuits of varying sizes at a test dictated angle during required environmental testing in an environmental test chamber.

BACKGROUND OF THE INVENTION

Integrated circuits for use by military contractors must be tested according to procedures set forth by the Department of Defense in MIL-STD-883C, Military Standard Test Methods and Procedures for Microelectronics.

Method 1009.8 of MIL-STD-883 specifies an accelerated laboratory corrosion test simulating the effects of sea coast atmosphere on device and package elements. This test requires that side braze and ceramic dual in-line packaged parts be placed in the atmospheric salt chamber in such a way that the package lids face up at a 45° angle. Pin grid arrays are to be placed in the testing chamber such that half the samples are situated with their caps or lids facing up at a 45° angle and half the caps or lids are situated facing down at a 45° angle. Additional test requirements specify that nothing shall touch the metalized surfaces of the packaged parts and that all surfaces must be uniformly exposed to the freely settling fog within the testing chamber.

These testing requirements create a difficult problem particularly in positioning and holding the packaged parts in the chamber for the duration of the test at the specified position and without contact to the metalized surface. Prior attempts to resolve these problems and meet all of the test standards consisted of providing a square frame formed of plastic rails laced with rubber bands. The frame was placed into the test chamber and the packaged parts were leaned against the rubber bands, approximating a 45° angle. This approach proved inadequate because the framework would not lie flat in the chamber and thus, in combination with the approximate positioning, the required 45° angle position could not be obtained consistently or, if obtained, maintained with certainty. In addition, the rubber bands would rapidly deteriorate in the salt fog during the test and eventually break which caused the test parts to fall to the bottom of the chamber. This approach was further inadequate because some portions of the metalized surface were either touched and/or were not properly exposed to the freely settling fog.

The present invention is directed to means and methods for unequivocally holding test parts of diverse shapes and sizes at the specified 45° angle for the duration of the test in such a manner that the metalized surfaces and all test part surfaces are uniformly exposed to freely settling fog.

BRIEF SUMMARY OF THE INVENTION

The present invention relates to means and method for efficiently an economically conducting contract required environmental chamber testing of prepackage integrated circuits. More particularly the present Invention comprises a plastic and magnet fixture that resolves prior art problems by providing a stable support for holding and maintaining prepackaged integrated circuits at a 45° angle which positioned within an environmental testing chamber while simultaneously avoiding contact with the metalized surfaces.

A block of polyvinylchloride ("PVC") or like plastic is fashioned into a body portion having a non-square such as an irregular hexagonal cross-section having a first and a second planer faces defined therein in spaced relationship to each other and disposed at a 45° to the vertical axis thereof. A plurality of substantially equispaced holes are defined across the respective faces thereof adjacent the leading edge thereof and in spaced generally parallel relationship thereto. A cylindrical shaped magnet is telescopically inserted randomly one each into one of the plurality of said holes and extends outwardly therefrom to proved a magnetic support surface upon which the prepackaged device or electronic elements are placed and secured in generally parallel spaced relationship to the planar face from which the magnet extends and at an attitude of 45° relative to the vertical axis of the body portion.

The magnetic attraction between the upward-facing metal lid of the prepackaged part and the magnet is strong enough to secure the part parallel to the 45° beveled face thereby solving the prior art problem of maintaining such parts at a 45° position in the chamber during the entire testing cycle. Furthermore, since each part is held in position from its bottom side only, the prior art problems of contact to metalized surfaces and obstructing surfaces from the settling fog have been resolved.

Accordingly, the primary object of the present invention is to provide a novel and improved means for support of prepackaged integrated circuit board and electronic device at a 45° attitude during environmental testing without metalized surface contact, while assuring that all exposed surfaces are contacted by freely settling fog.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

BRIEF DESCRIPTION OF THE DRAWINGS

In the drawings:

FIG. 1. is an isometric view of a support fixture embodying the present invention;

FIG. 2. is a frontal view of the device of FIG. 1;

FIG. 3. is a cross-section taken on line 3—3 of FIG. 1; and

FIG. 4. is an isometric view of a magnet.

DESCRIPTION OF PREFERRED EMBODIMENTS

The present invention relates to a test fixture for assuring complete compliance with government promulgated environmental test procedures in the manufacture and inspection of microelectronic parts and devices.

Referring to the drawings and particularly FIGS. 1, 2 and 3, the test fixture hereof is identified by the general reference 10 and comprises a solid body portion 11 having a first vertical side face 12, a second, vertical side face 13, a first sloped side face 14, a second sloped side face 15, a top surface 16 and a base plate 20.

Sloped side faces 14, 15 are integrally formed with top surface 16 and extend downwardly therefrom at an angle 18 therefrom which angle when MIL-STD883C must be met, will be 45°. The lower edge of surfaces 14, 15 integrally join vertical side surfaces 12, 13, respectively, at an angle 19 which will be complementary to angle 18, that is, the sum of the angle 18 plus the angle 19 will equal 90°.

In cross-section, as shown in FIG. 3, body portion 11 comprises a rectangular lower section and a trapezoidal upper section and is seated upon base plate 20 which is rectangularly shaped and extends outwardly from vertical faces 12, 13 to provide a stable base for fixture 10. A plurality of circular holes 23 are drilled into each sloped surface 14, 15 in spaced relationship to each other and generally parallel to upper surface 16. Holes 23 are preferably spaced uniformly across the respective surfaces 14, 15, as shown in FIGS. 3 and 4. A plurality of free fitting magnets 24, as shown in FIG. 4, each possessing sufficient magnetic force to firmly attract and hold the desired test part 26, are set into preselected ones of holes 23 at spaced at preselected intervals sufficient to accommodate the part 26 to be tested.

In the preferred practice, as shown in FIGS. 3 and 4, each magnet 24 will be formed in an elongated shape having a cross-section which conforms to the shape of hole 23 so that one end thereof can be telescopically inserted into hole 23 in a reasonably secure non-wobbly relationship thereto as it extends therefrom. The parts to be tested 26 are then placed against the outer most end of each magnet 24, face up or down as required by the pertinent test specifications, where they are held in place by the magnetic attraction of magnet 24. The fixture 10, when loaded, is placed in an atmospheric salt or humidity chamber for accelerated corrosion testing in accordance with the applicable test standards. While the material of choice for the fixture is polyvinylchloride plastic, any material having similar electrical and mechanical properties may be used.

Fixture 10 holds the packaged test parts 26 securely in the indicated or other environmental test chambers at any angle required which will be obtained by the provision of the appropriate angle 18.

In operation, fixture 10 is placed on a work bench adjacent to several parts to be tested. Next, a magnet 24 is inserted into each of that number of holes 23 as is necessary to support the number of parts to be tested without any of the parts touching each other. When fixture 10 is loaded, the several parts to be tested are disposed in spaced parallel relationship to the plane of the corresponding sloped surface. When the test parts are fully deployed, the loaded fixture is placed within the desired test chamber end the test conducted.

Once the test is complete, the fixture is removed from the test chamber and the tested parts are collected by removing each from the magnetic pedestal upon which it was mounted. The parts are thereafter inspected in accordance with the designated protocol.

The fixture and it is attendant parts may then be cleaned and made ready for subsequent use.

From the foregoing, it is readily apparent that a useful embodiment of the present invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. A fixture for supporting electronic parts in a fixed position for environmental testing comprising; a body portion, a vertical axis and a horizontal axis and first and second sloped surfaces disposed at a preselected angle relative to the said horizontal and said vertical axis; and means defined in each said sloped surface for magnetically supporting electronic parts in spaced generally parallel relationship to said sloped surfaces, said means comprising a plurality of holes defined in said surface to a preselected depth and a plurality of magnets, each said magnet adapted for insertion into a preselected one of said holes and having a length greater than said preselected depth.

2. A fixture according to claim 1 in which each of said holes is round and each of said magnets is cylindrical.

3. A fixture according to claim 2 in which said length of each magnet is at least twice the preselected depth of each of said holes.

4. A fixture according to claim 1 in which each of said sloped surfaces has an upper edge and said plurality of holes defined in each of said sloped surfaces being in spaced generally parallel relationship to said upper edge and in equi-spaced relationship to each other, and said plurality of magnets adapted for insertion in preselected ones of said holes for outward extension therefrom.

5. A fixture according to claim 4 in which each of said holes is round and each of said magnets is cylindrical.

6. A fixture for supporting electronic parts in a fixed position for environmental testing comprising; a body portion, a vertical axis and a horizontal axis and first and second sloped surfaces disposed at a preselected angle of 45° relative to the said horizontal and said vertical axis; and means defined in each said sloped surface for magnetically supporting electronic parts in spaced generally parallel relationship to said sloped surfaces, said means comprising a plurality of holes defined in said surface to a preselected depth and a plurality of magnets, each said magnet adapted for insertion into a preselected one of said holes and having a length greater than said preselected depth.

7. A fixture according to claim 6 in which each of said holes is round and each of said magnets is cylindrical.

8. A fixture according to claim 7 in which said length of each magnet is at least twice the preselected depth of each of said holes.

9. A fixture according to claim 6 in which each of said sloped surfaces has an upper edge and said plurality of holes defined in each of said sloped surfaces being in spaced generally parallel relationship to said upper edge and in equi-spaced relationship to each other, and said plurality of magnets adapted for insertion in preselected ones of said holes for outward extension therefrom.

10. A fixture according to claim 9 in which each of said holes is round and each of said magnets is cylindrical.

* * * * *